US006230756B1

(12) United States Patent
Baumann et al.

(10) Patent No.: US 6,230,756 B1
(45) Date of Patent: May 15, 2001

(54) HEDDLE SYSTEM

(75) Inventors: Hans Baumann, Horgen; Franz Mettler, Wollerau, both of (CH)

(73) Assignee: Grob Horgen AG (CH)

( * ) Notice: Subject to any disclaimer, the term of this patent is extended or adjusted under 35 U.S.C. 154(b) by 0 days.

(21) Appl. No.: 09/613,725

(22) Filed: Jul. 11, 2000

(30) Foreign Application Priority Data

Jul. 13, 1999 (DE) ..... 199 32 685

(51) Int. Cl.[7] ..... D03C 9/00
(52) U.S. Cl. ..... 139/93; 139/93; 139/94
(58) Field of Search ..... 139/52, 93, 94

(56) References Cited

U.S. PATENT DOCUMENTS 5,052,446 * 10/1991 Gysin ..... 139/93
5,078,184 * 1/1992 Koch ..... 139/93
5,152,325 * 10/1992 Koch ..... 139/91
5,758,696 * 6/1998 Nishikawa ..... 139/1 R
5,816,294 * 10/1998 Speich ..... 139/91
6,105,623 * 8/2000 Tonz et al. ..... 139/93
6,176,270 * 1/2001 Mettler ..... 139/93

FOREIGN PATENT DOCUMENTS 40 23 498 10/1991 (DE) .
195 48 176 8/1996 (DE) .

* cited by examiner

*Primary Examiner*—John J. Calvert
*Assistant Examiner*—Robert Muromoto, Jr.
(74) *Attorney, Agent, or Firm*—Dykema Gossett PLLC

(57) ABSTRACT

A heddle system for mechanical looms consisting of heddles (51) as well as upper and lower heddle slide bars (52, 53) that are attached to a heddle frame whereby said heddles are lined up on said heddle slide bars. Said heddles are provided with two end eyes (56, 57) whereby the ones (56) that are disposed within the heddle frame and above the warp threads have less play in longitudinal direction of the heddles, while said heddle eyes encompass the upper heddle slide bar (52), in comparison to the particular end eyes (57) that are disposed below the warp threads. The upper and lower heddle slide bar has each a different cross-sectional dimension or a difference width according to one embodiment version.

14 Claims, 3 Drawing Sheets

HEDDLE SYSTEM

The present invention relates to heddles and to heddle slide bars onto which heddles are lined up. The heddle slide bars are either stationary or detachably connected to the heddle frames and are in this respect a component of the heddle frame. Their shape or their cross-sectional dimensions must correspond functionally to the shape of the end eyes of the heddles; therefore, the heddles together with slide bars form a system Up to now, three systems have succeeded and are still in use:

heddles with O-shaped end eyes (FIG. 1)

heddles with J-shaped end eyes (FIG. 2)

heddles with C-shaped end eyes (FIG. 3).

In these conventional systems there is a heddle slide bar, which is adjusted to the heddle and which is a component of the system. All three systems have certain advantages and disadvantages, depending on the type of use. They have in common that the heddle has a lot of play in the longitudinal direction of the heddles because of the size of the end eye relative to the heddle slide bar. This has the advantage that in the production of the heddle slide bar and the heddles, a relative large tolerance can be allowed, which decreases the cost of manufacturing. In addition, easy sliding of the heddle on the heddle slide bar is ensured as a matter of fact. This is above all of significance when the heddles are automatically line up on the heddle slide bars with the aid of machines. In weaving, the large play between heddles and the heddle slide bar allows also a significant deformation of the heddle frame to which the heddle slide bars are fastened—without tearing the heddles apart.

This play starts to become a disadvantage in the currently usual (high) speed of newly installed mechanical looms. It is especially the wear of the end eyes of the heddles which can weaken said end eyes within a few months to such a degree that they break apart and cause interruptions during weaving. In most cases, prior wear of the metal by friction represents already trouble. It may cause a considerable and damaging soiling of the woven fabric. An additional problem is the slanting of the heddle during weaving, which is enhanced by the large play between heddle and heddle slide bar. This slanting, which may also appear as swaying, results in breaking of the warp thread.

To eliminate swaying, it was suggested in DE 195 48 176 to design a heddle end eye "lay-free" relative to the heddle slide bar. Without doubt, this solves certain wear problems or prevents uncontrolled slanting of the heddle. However, this solution is unusable since the heddles have to be moved by sliding on the heddle slide bar to be lined up. Especially important is the ability to slide during the use of an automatic feeding machine.

Limitation—but not complete elimination—of the play in the heddle relative to the heddle slide bar comes considerably closer to a solution. A beginning to that is indicated in DE 40 23 572.

As solution to the wear problem it is now suggested, according to the invention, to provide the heddles with various end eyes according to the text in claim 1 and according to an embodiment version and in combination with different heddle slide bars, if necessary.

Preferred embodiments of such a system of heddle and heddle slide bar is described in the dependent claims.

A significant characteristic of the novel heddle is the fact that the limitation of the play of the end eye occurs in longitudinal direction of the heddles, relative to the heddle slide bar, only on the one end eye that is disposed within the mechanical loom above the warp threads. The play is limited at this location, for example, to 0.4 mm as a minimum and approximately 1.2 mm as a maximum, with a preferred value of approximately 0.8 mm whereby a certain tolerance of ±0.2 nm must be accepted for manufacturing reasons. Since a considerable change has been created relative to the currently common 4.5 or more millimeter of play, it is advantageous according to the invention that the heddle slide bar has adjusted dimensions. The size is adjusted to the play conditions and optimized in view of the weight, which means the size is reduced. Possible embodiments are illustrated in the following described FIG. 4 through FIG. 6. The upper heddle slide bar is preferably made in the dimensions of 1.5×14 mm instead of the currently usual 1.7×22 mm, as illustrated in the following described FIG. 3

In contrast to the upper end eye, the lower end eye is made larger and it is designed with having a play of 1.5–5 mm relative to the heddle slide bar. It is proposed, according to the invention, to adjust the play in increments of 1 mm to correspond to the characteristic features of the heddle frame. The more rigidly the heddle frame is designed, the less play can be selected since it only serves to compensate or absorb the not-so-exact constant distance between the heddle slide bars that are attached at the upper and lower side of the heddle frame, without tearing the heddle apart. The lower heddle slide bar is made purposely with larger dimensions that the upper one. The reason for this is the fact that at very large play, the relative movement between heddle and heddle frame results in wear on the heddle slide bar and the heddle. While the heddle is inexpensive and replacement may be performed in a simple manner, the heddle slide bar is relatively costly and replacement is often times impossible. Therefore, at least the lower support bar of the heddle frame and the heddle slide bar have to be replaced. A corresponding enlargement of the heddle slide bar allows more wear before a functional breakdown occurs. Enlargement of the lower heddle slide bar is therefore of advantage based on the unavoidable wear thereof A heddle designed according to the invention has still sufficient freedom of movement between the upper end eye and the upper heddle slide bar to be able to be moved during feeding without binding and to be able to easily follow the irregularities in the warp thread flow during weaving. However, the play is small enough so that vibrations of the heddle frame result only in a very small relative movements between heddle and heddle slide bar. Thereby, wear between heddle and heddle slide bar is reduced to such an extent that no detrimental fabric soiling may develop. In addition, the operational life of the heddle and the heddle slide bar will be extended considerably. Traversing tilting motions in the way of swaying or slanting of the heddle are certainly also prevented without a "play-free" guide being necessary for the heddle. Just the same, the large play of the lower end eye relative to the lower heddle slide bar allows that traditional less bending-resistant heddle frame constructions may be utilized with this system. Any developing dust by friction falls downward out off the heddle frame and does not interfere in this respect. Occasional replacement because of wear is limited to the heddles and occasionally to the lower heddle slide bars, however, at much lower intervals. Nevertheless, the manufactured fabric may be used as "first quality" since the soiling caused by friction at the upper heddle slide bar is minute and almost not noticeable. With the choice of a bending-resistant, modern frame construction, the innovative heddle system prevents the disadvantages caused by friction at the lower heddle slide bar since one can operate the lower heddle slide bar with less play and thereby with less wear.

For the time being there is one configuration enough according to the following described FIG. 8 or FIG. 9 to be employed with already existing heddle frames and their heddle slide bars. Admittedly, premature wear of heddle and heddle slide bars cannot be avoided; however, the smaller play between the upper end eye of the heddle and the upper heddle slide bar reduces the occurrence of uncontrolled vibrations to a great extent. Thereby, wear at the lower end eye is already considerably reduced. The most important advantage is thereby already realized, namely the prevention of substantial wear between the upper end eye of the heddle and the heddle slide bar, whereby it is made again possible to manufacture flawless woven fabrics even at very high weaving speeds.

An additional improvement of wear conditions may be realized whereby the heddles or the heddle slide bars, or both, are provided with wear-resistant coatings. Such coatings are particularly recommended since the choice of material (for heddles) is very limited. The limitation is determined, for example, by the manufacturing process of the heddles, which are punched out to allow cost-effective production. Should a substantially harder material be used to reduce wear further, than the ability for punching would be considerably reduced. It is therefore recommended to rather make the manufactured heddles or heddle slide bars more wear-resistant. This may be accomplished by coatings according to so-called PCD and CVD technologies (physical and chemical vapor deposition). Since such coatings have also smoothening characteristics, the sliding movement of the heddles on the heddle slide bar is also influenced favorably.

Since at least during the introduction phase of the innovative heddle system, the traditional systems are still being used in the same weaving mill, there is a demand for the introduction of identifiers that allow an automatic differentiation between the two systems. The current traditionally used gable-like or wave-like shape of the end eye would preferably be changed. This could be done, for example, by concave shaping whereby the distance between the outer end of the heddle and the upper end of the end eye would be changed in comparison to the traditional designs. Such heddles would be easily distinguishable by the naked eye but they could also be detected with a mechanical examining device or an electro-optical control device. A corresponding device would be preferably installed on an automatic feeding machine whereby the unintentional mixing of heddles would be prevented, be it traditional systems or a system according to the invention.

It may be assumed that the current automatic feeding machines would also be adjusted for use with the novel heddle system. Therefore the heddles according to the innovative system are provided, for instance, with the known embossed segments as they are needed in known automatic feeding machines.

The innovation will now be described in more detail with reference to the accompanying figures.

Figure 1:
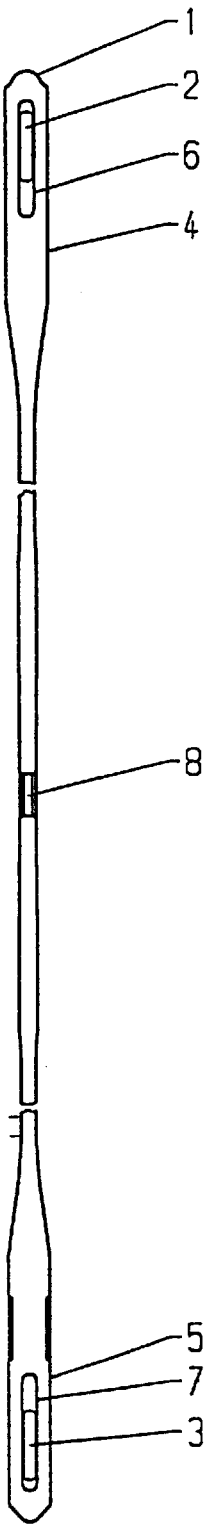
Fig.1 (PRIOR ART)
FIGS. 1–3 show embodiments of currently used heddle systems for broad looms whereby the end eyes of the heddles as well as the heddle slide bars have the same dimensions and cross sections on top and below.

FIG. 1 shows a conventional heddle (1) with the so-called closed O-shape of the end eyes (4 and 5) together with the heddle slide bars (2 and 3). The dimensions of the upper heddle slide bar (2) and the lower heddle slide bar (3) are the same, and so are the dimensions of the upper end eye opening (6) and the lower end eye opening (7). The play between end eye opening and heddle slide bar amounts to approximately 4.5 mm above and below, depending on the manufacturer. The warp thread runs through the thread eyelet (8), which is disposed at the middle section, mostly in the center or slightly above.

Figure 2:
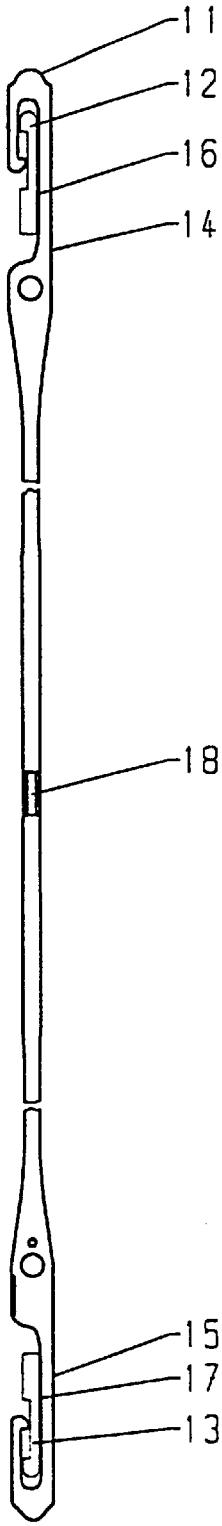
Fig.2 (PRIOR ART)

FIG. 2 shows a conventional heddle (11) with the so-called open J-shape of the end eyes (14 and 15) together with the heddle slide bars (12 and 13). The dimensions of the upper heddle slide bar (12) and the lower heddle slide bar (13) are the same, and so are the dimensions of the upper end eye opening (16) and the lower end eye opening (17). The play between end eye opening and heddle slide bar amounts to approximately 4.5 mm above and below, depending on the manufacturer. The warp thread runs through the thread eyelet (18), which is disposed at the middle section, mostly in the center or slightly above.

Figure 3:
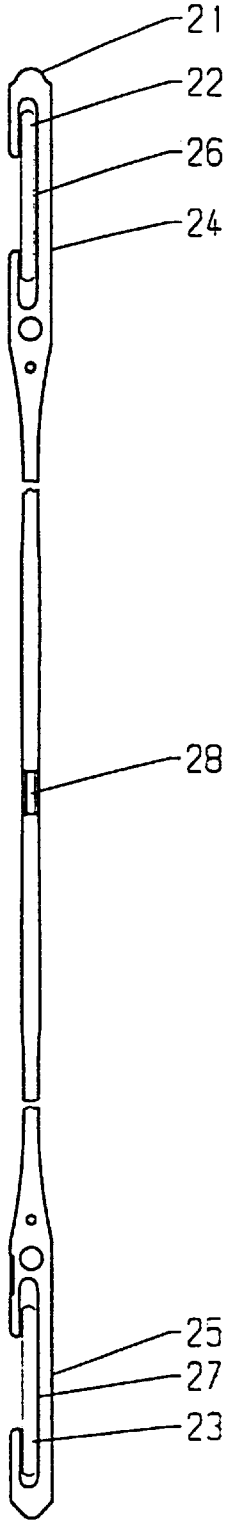
Fig.3 (PRIOR ART)

FIG. 3 shows a conventional heddle (21) with the so-called open C-shape of the end eyes (24 and 25) together with the heddle slide bars (22 and 23). The dimensions of the upper heddle slide bar (22) and the lower heddle slide bar (23) are the same, and so are the dimensions of the upper end eye opening (26) and the lower end eye opening (27). The play between end eye opening and heddle slide bar amounts to approximately 4.5 mm above and below, depending on the manufacturer. The warp thread runs through the thread eyelet (28), which is disposed at the middle section, mostly in the center or slightly above.

Figure 4:
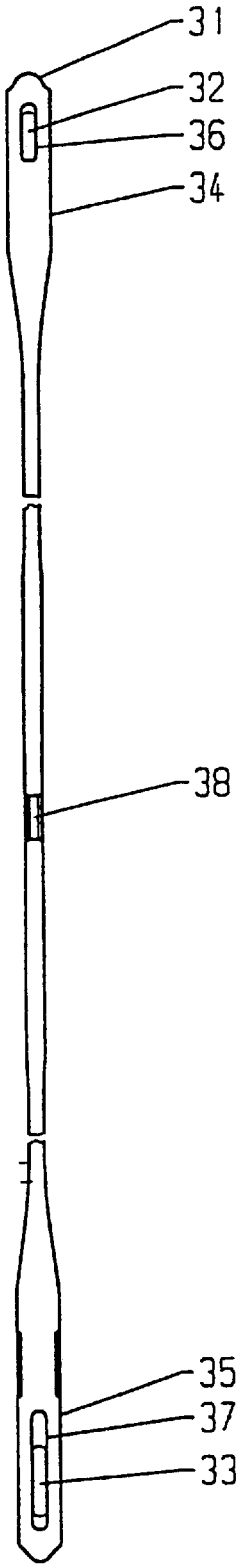
FIGS. 4–6 show various heddles designed according to the invention, which are similar to the ones illustrated in FIGS. 1–3.

FIG. 4 shows a heddle system designed according to the invention with the so-called closed O-shape of the end eyes. The end eye openings (36) in the upper end eye (34) of the innovative heddle (31) encompasses the heddle slide bar (32), which is designed with small dimensions and optimum weight, and having a play of approximately 0.8 mm. The lower heddle slide bar (33) is made considerably larger and has a play of approximately 5 mm relative to the end eye opening (37) of the lower end eye (35). The warp thread is guided through the thread eyelet (38).

Figure 5:
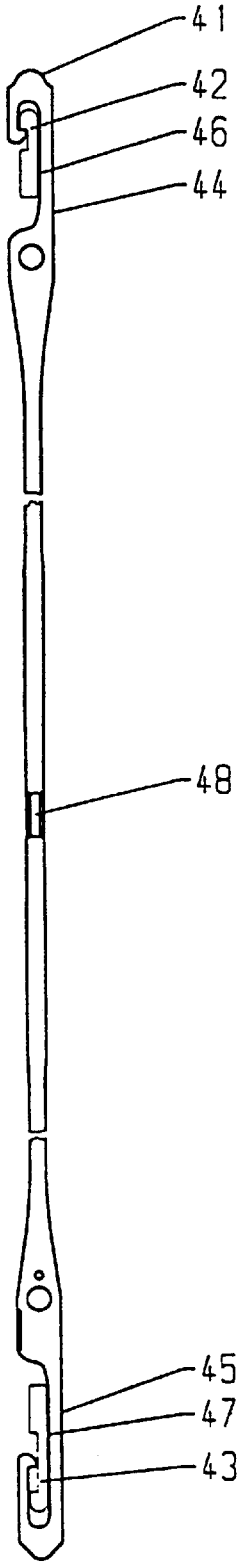

FIG. 5 shows a heddle system designed according to the invention with the so-called open J-shape of the end eyes. The end eye openings (46) in the upper end eye (44) of the innovative heddle (41) encompasses the heddle slide bar (42), which is designed with small dimensions and optimum weight, and having a play of approximately 0.8 mm. The lower heddle slide bar (43) is made considerably larger and has a play of approximately 5 mm relative to the end eye opening (47) of the lower end eye (45). The warp thread is guided through the thread eyelet (48).

Figure 6:
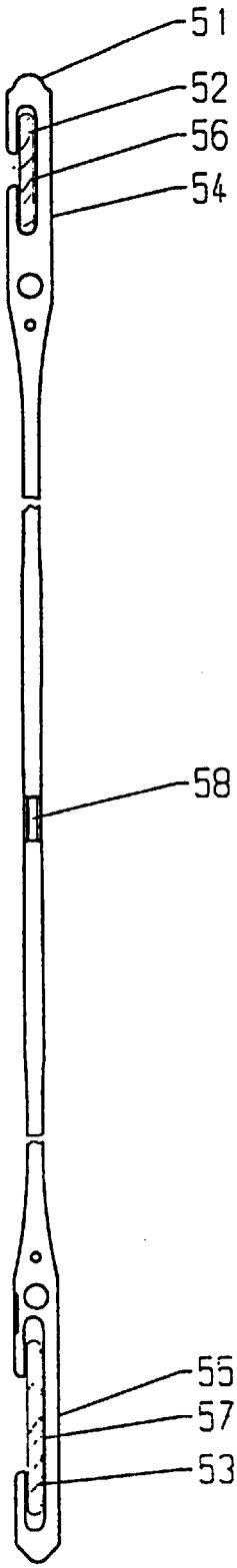

FIG. 6 shows a heddle system designed according to the invention with the so-called open C-shape of the end eyes. The end eye openings (56) in the upper end eye (54) of the innovative heddle (51) encompasses the heddle slide bar (52), which is designed with small dimensions and optimum weight, and having a play of approximately 0.8 mm. The lower heddle slide bar (53) is made considerably larger and has a play of approximately 5 mm relative to the end eye opening (57) of the lower end eye (55). The warp thread is guided through the thread eyelet (58).

Figure 7:
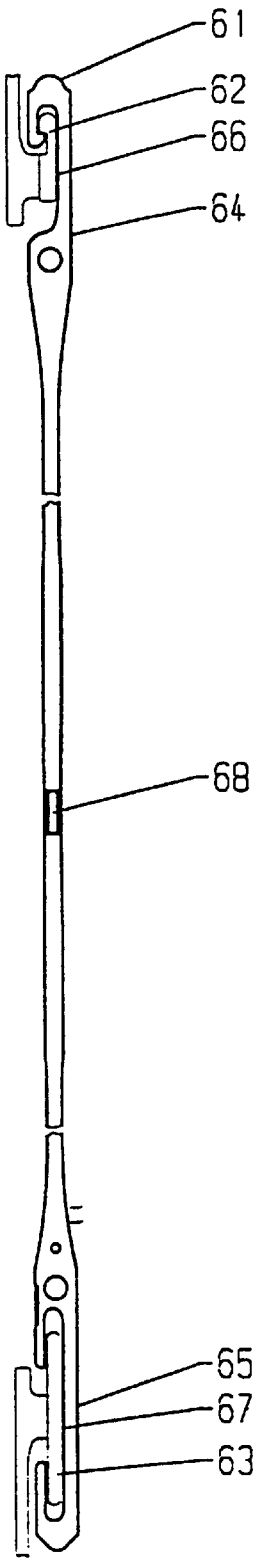
FIG. 7 shows an additional heddle system designed according to the invention having two different cross-sectional dimensions for the heddle slide bar to be used for staple fiber weaving.

FIG. 7 shows a heddle system designed according to the invention, having two different cross-sectional dimensions for the heddle slide bar to be used for staple fiber weaving. The heddle (61) designed according to the invention is provided at the upper end eye (64) with an inner end eye shape (66) similar to the J-shape and encloses a heddle slide bar (62) with a play of approximately 0.8 mm, which also corresponds to the so-called J-shape. The lower end eye (65), which encloses the heddle slide bar (63) with a play of approximately 5 mm, is shaped at its inner edge (67) to fit against the heddle slide bar (63) and corresponds to the so-called open C-shape.

A very different heddle system, still according to the invention, is an embodiment recommended for staple fiber weaving whereby the upper heddle slide bar has a shape according to FIG. 5 and the lower heddle slide bar has a shape according to FIG. 6. The thereby created heddle is illustrated in FIG. 7. It has the advantage that no (loose) fiber accumulation can develop in the region of the upper end eye. Thereby the better characteristics are combined relative to the guiding of the heddle by having the cross section of the heddle slide bar in an oval shape in the region of the lower end eye.

Figure 8:
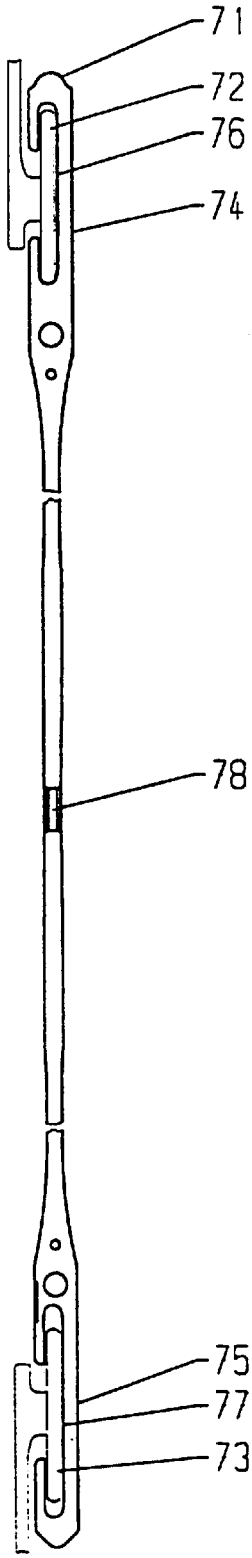
FIG. 8 and FIG. 9 show yet another heddle system designed according to the invention, which are particularly intended for employment in already existing heddle frames.

FIG. 8 shows a heddle (71) designed according to the invention with the so-called open C-shape, which is intended for employment in already existing heddle frames. The heddle slide bar (72), which corresponds to the norm, is enclosed by the inner edge (76) of the end eye (74) with a play of approximately 0.8 mm. At the opposite end, the heddle slide bar (73) is enclosed by the inner edge (77) of the lower end eye (75) with a play of approximately 5 mm, also corresponding to the norm The warp thread is guided through the thread eyelet (78).

Figure 9:
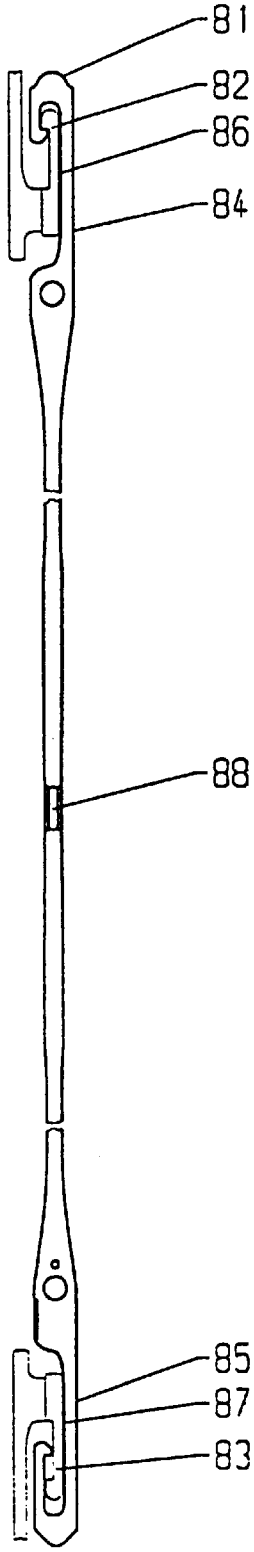

FIG. 9 shows a heddle (81) designed according to the invention with the so-called open J-shape, which is intended for employment in already existing heddle frames. The heddle slide bar (82), which corresponds to the norm, is enclosed by the inner edge (86) of the end eye (84) with a play of approximately 0.8 mm. At the opposite end, the heddle slide bar (83) is enclosed by the inner edge (87) of the lower end eye (85) with a play of approximately 5 mm, also corresponding to the norm. The warp thread is guided through the thread eyelet (88).

The heddle systems illustrated in FIG. 4 through FIG. 9 according to the invention represent only examples and are an incomplete selection of embodiment versions. Of course, there are possible additional combinations of differently designed end eyes and heddle slide bars or heddle slide bar shapes. It is particularly also possible to make the heddles and the heddle slide bars either out of metallic material, such as stainless steel or aluminum, or out of polymeric material, such as reinforced polymers. In case of the use of polymeric material, there are particularly fiber-reinforced synthetic materials suitable, as for example, so-called carbon fiber or reinforced aramide fiber composites. However, the choice of materials is not the main consideration, but important is the configuration of the end eye and possibly a different design of the heddle slide bars, which are optionally combined therewith.

What is claimed is:

1. A heddle system for mechanical looms comprising a plurality of heddles and upper and lower heddle slide bars attached to a heddle frame wherein the heddles are lined up on said heddle slide bars; the improvement wherein the heddles are provided with two end eyes, wherein one of said eyes are disposed within the heddle frame and above the warp threads and have less play in a longitudinal direction of the heddles, and said one of said eyes encompassing the upper heddle slide bar, the other of the end eyes being disposed below the warp threads.

2. A heddle system according to claim 1, wherein the upper and lower heddle slide bar each have a different cross-sectional dimension.

3. A heddle system according to claims 1, wherein the one end eye of the heddle that is disposed above the warp thread encompasses the corresponding heddle slide bar with a play of 0.4 mm to a maximum of 1.2 mm, preferably 0.8 mm.

4. A heddle system according to one of the claims 1, wherein the other end eye of the heddles that is disposed below the warp threads encompasses the corresponding heddle slide bar with a play of approximately 1.5 mm to 6.5 mm, preferably 5 mm, whereby the play depends on the stiffness of the heddle frame or the material being used and whereby said play is adjusted to this stiffness.

5. A heddle system according to one of the claims 1, wherein the heddle slide bar that is disposed above the warp thread has a smaller cross-sectional dimension than the heddle slide bar that is below the warp threads.

6. A heddle system according to claim 1, wherein the two heddle slide bars have different cross-sectional shapes.

7. A heddle system according to claim 1, wherein the cross-sectional dimensions of the heddle slide bars above and below the warp thread are the same.

8. A heddle system according to claim 1, wherein the heddles are made of metallic material, particularly steel or aluminum.

9. A heddle system according to claim 1, wherein the heddles comprise a polymeric material, particularly a reinforced polymer.

10. A heddle system according to claim 1, wherein the heddle slide bars are made of metal, particularly steel or aluminum.

11. A heddle system according to claim 1, wherein the heddle slide bars comprise a polymeric material, particularly a reinforced polymer.

12. A heddle system according to claim 1, wherein the heddles are covered with coatings, which are wear-resistant and make sliding of the heddles easier.

13. A heddle system according to claim 1, wherein the heddle slide bars are covered completely or partially with coatings, which are wear-resistant and make sliding of the heddles easier, and which are produced by means of a PVD or CVD process.

14. A heddle system according to claim 1, wherein the heddles have end shapes that make identification of the design possible by mechanical or electro-optical means to differentiate the heddles.

* * * * *